US010784624B2

(12) United States Patent
Quast et al.

(10) Patent No.: US 10,784,624 B2
(45) Date of Patent: Sep. 22, 2020

(54) PROTECTIVE SEPARATOR FOR A RIGHT ANGLE PLUG CONNECTION

(71) Applicant: HARTING ELECTRIC GMBH & CO. KG, Espelkamp (DE)

(72) Inventors: Frank Quast, Bielefeld (DE); Thomas Beischer, Espelkamp (DE); Peter Giesbrecht, Porta Westfalica (DE); Albert Ferderer, Espelkamp (DE)

(73) Assignee: HARTING ELECTRIC GMBH & CO. KG, Espelkamp (DE)

( * ) Notice: Subject to any disclaimer, the term of this patent is extended or adjusted under 35 U.S.C. 154(b) by 0 days.

(21) Appl. No.: 16/484,267

(22) PCT Filed: Feb. 22, 2018

(86) PCT No.: PCT/DE2018/100159
§ 371 (c)(1),
(2) Date: Aug. 7, 2019

(87) PCT Pub. No.: WO2018/157885
PCT Pub. Date: Sep. 7, 2018

(65) Prior Publication Data

US 2020/0006894 A1 Jan. 2, 2020

(30) Foreign Application Priority Data

Feb. 28, 2017 (DE) ..... 10 2017 104 123

(51) Int. Cl.
*H01R 13/60* (2006.01)
*H01R 13/633* (2006.01)
(Continued)

(52) U.S. Cl.
CPC ..... *H01R 13/633* (2013.01); *H01R 13/506* (2013.01); *H01R 13/6215* (2013.01)

(58) Field of Classification Search
CPC . H01R 13/633; H01R 13/506; H01R 13/6215
(Continued)

(56) References Cited

U.S. PATENT DOCUMENTS 3,404,362 A * 10/1968 Amendola ..... H01R 13/645 439/79
3,599,167 A 8/1971 Adrian et al. ..... 339/42
(Continued)

FOREIGN PATENT DOCUMENTS

DE 29505601 5/1995 ..... H01R 13/516
DE 102007023019 11/2008 ..... H01R 13/639
(Continued)

OTHER PUBLICATIONS

International Preliminary Report on Patentability issued in application No. PCT/DE2018/100159, dated Sep. 3, 2019, English translation (10 pgs).
(Continued)

*Primary Examiner* — Alexander Gilman
(74) *Attorney, Agent, or Firm* — Hayes Soloway P.C.

(57) ABSTRACT

Disclosed is a protective separator for a rectangle plug connection, which is appropriate for cost-effective and uncomplex retrofitting to existing rectangle plug connections, and permits the deliberate and reversible separation of the plug connection in response to increased mechanical loading, in order to prevent mechanical damage and, optionally, to permit the most rapid resumption of operation possible. This disclosure includes a protective separator for a rectangle plug connection, having a bulkhead mounted housing having a first region and a second region, wherein the first region is directly attachable to a surface and/or to a surface mounted housing, and wherein the second region can be locked onto a mating plug housing, wherein the first
(Continued)

region and the second region can be mutually separated in a reversible manner by the action of a predefined tensile force.

18 Claims, 9 Drawing Sheets

(51) Int. Cl.
*H01R 13/506* (2006.01)
*H01R 13/621* (2006.01)

(58) Field of Classification Search
USPC ..... 439/153
See application file for complete search history.

(56) References Cited

U.S. PATENT DOCUMENTS 4,158,757 A * 6/1979 Reichert ..... H01H 9/04 174/564
5,066,246 A * 11/1991 Jensik ..... H01R 13/6215 29/842
5,658,156 A * 8/1997 Henderson ..... H01R 12/716 439/79
5,658,162 A * 8/1997 Harting ..... H01R 13/62966 439/372
7,184,272 B1 * 2/2007 Harlacher ..... H01R 24/40 361/728
8,206,184 B2 * 6/2012 Kwasny ..... H01R 13/506 439/695
9,320,182 B2 * 4/2016 Steger ..... H01H 9/52
10,143,102 B2 * 11/2018 Bury ..... H05K 7/1441
2004/0141692 A1 * 7/2004 Anderson ..... G02B 6/3825 385/53
2005/0059284 A1 * 3/2005 Thurston ..... H01R 13/623 439/314
2005/0186857 A1 * 8/2005 Sichner ..... H01R 13/514 439/717
2006/0086521 A1 * 4/2006 Andresen ..... H02G 3/086 174/50
2006/0136622 A1 * 6/2006 Rouvelin ..... H05K 5/0021 710/62

FOREIGN PATENT DOCUMENTS

DE 202008005250 8/2009 ..... H01R 13/73
DE 202009014961 3/2011 ..... H01R 13/502
DE 102011078348 1/2012 ..... H01R 13/629
EP 0731534 9/1996 ..... H01R 13/629
EP 1995829 11/2008 ..... H01R 13/645

OTHER PUBLICATIONS

German Office Action (w/machine translation) issued in application No. 10 2017 104 123.0, dated Sep. 20, 2017 (7 pgs).
International Search Report (w/translation) and Written Opinion (w/machine translation) issued in application No. PCT/DE2018/100159, dated Apr. 26, 2018 (18 pgs).

* cited by examiner

PROTECTIVE SEPARATOR FOR A RIGHT ANGLE PLUG CONNECTION

The invention proceeds from a protective separator for a right angle plug connection.

The function of protective separators of this type is the deliberate separation of a plug connector from a mating connector which is connected thereto in the event of mechanical loading, in order to protect said plug connector or its environment against damage.

PRIOR ART

In the prior art, for example from printed publication DE 29 505 601 U1, heavy duty rectangle plug connectors are known, which are characterized by a high loading capacity and high stability. They are employed, for example, in high-current applications, and are designed for the transmission of high electrical capacities, but also for signal and data transmission functions which are subject to the most stringent requirements and the most demanding environmental conditions. For the purposes of screening and mechanical protection, rectangle plug connectors of this type are generally provided with a robust metal housing of a basic rectangular shape, and are primarily employed in industrial applications.

In printed publication DE 10 2007 023 019 B4, moreover, three different embodiments of housing substructures for rectangle plug connectors are described. These different embodiments comprise the bulkhead mounted housing, the surface mounted housing and the (flying) clutch housing. The bulkhead mounted housing can be fitted, for example, to a wall bushing, which incorporates a contact insert. The locking bracket permits the rapid and simple connection of a bush housing incorporating a contact insert.

The surface mounted housing, conversely, can be employed in a variety of locations, independently of wall bushings and by the standalone incorporation of a contact insert, and can be rapidly locked to a bush housing with a contact insert by means of the locking bracket. The clutch housing equipped with a locking bracket incorporates no flange for attachment to surfaces, for example cabinet walls or similar, but is employed for rapid connection with a bush housing.

A particularly user-friendly and stable locking bracket is disclosed in printed publication EP 0 731 534 A2. It is characterized in that very high retaining forces can be achieved with exceptionally low actuating forces.

Under certain circumstances, however, high retaining forces of this type can also have their disadvantages. For example, a problem can arise if, as a result of incorrect operation, very high tensile forces are applied to a cable, which are consequently transferred to the mating connector, thereby potentially resulting in severe damage.

For example, in the field of vehicle charging plugs, the general application issue is known, wherein an electric vehicle is unintentionally driven away from a charging column, without the prior release and removal of the plug of an associated charging cable. If the plug connection is not released automatically, for example, the charging column can be destroyed, or even more severe damage can occur in consequence. To this end, printed publication DE 10 2011 078 348 A1 proposes a connector arrangement having a support structure and a fitting component which are mutually separated if the connector arrangement is subject to a transverse load which exceeds a predefined threshold value.

The risk of the destruction of a plug connection by an excessively high tensile load also occurs in the industrial sector. In this sector, moreover, extremely complex and permanently installed electrical energy networks also exist, e.g. for production lines and installations, which are equipped with heavy duty rectangle plug connectors and, as far as possible, are intended to operate in an uninterruptible manner, in order to permit the a generation of a cost-effective return and prevent any bottlenecks in the production process.

Rectangle plug connectors of this type are also known from the prior art.

Printed publication US 2004/0141692 A1 discloses a mounting device for the multi-channel connection of a high-sensitivity optical plug connector which is arranged for latching on both sides thereof. This device incorporates a rectangular frame, which is attachable to a wall bushing by means of a flange, together with corresponding inserts.

Printed publication DE 20 2008 005 250 U1 discloses a plug connection of rectangular cross-section having a first plug connector and a second intermateable plug connector. The first plug connector comprises a flange plate which, by means of one or more mounting means, is attachable to a wall. The second plug connector is preferably designed for the connection of a cable and is configured such that the connector face thereof entirely or partially covers the one or more mounting means of the flange plate.

Printed publication DE 20 2009 014 961 U1 discloses a displaceable security element for the detachable locking of a locking element of a rectangle plug connector.

Unfortunately, there is a disadvantage according to the prior art in that, at present, no protective separator for such rectangle plug connections exists so as yet which separates automatically in response to mechanical loading. Specifically, there is a lack of an uncomplex protective separator which can be rapidly and cost-effectively retrofitted to existing, and specifically to previously installed rectangle plug connections.

SUMMARY OF THE INVENTION

The object of the invention is the disclosure of a protective separator for a rectangle plug connection, which is appropriate for cost-effective and uncomplex retrofitting to existing rectangle plug connections, and permits the deliberate and reversible separation of the plug connection in response to increased mechanical loading, in order to prevent mechanical damage and, optionally, to permit the most rapid resumption of operation possible.

The protective separator for a rectangle plug connection comprises a bulkhead mounted housing having a first region and a second region, wherein the first region is directly attachable to a surface and/or to a surface mounted housing, and wherein the second region can be locked onto a mating plug housing, wherein the first region and the second region can be mutually separated in a reversible manner by the action of a predefined tensile force.

The bulkhead mounted housing comprises two reversibly separable regions, namely, the first region and the second region. The first region, specifically by means of an associated first fixing section, is attachable to said surface, for example a wall, specifically the wall of a switch cabinet, but, in an advantageous configuration, is also attachable to the surface mounted housing. The second region can be locked onto the mating plug, and thus onto the mating plug housing.

The invention provides an advantage, in that rectangle plug connections are protected against mechanical destruction by exceptionally strong tensile forces, e.g. exceptionally strong cable tensile forces. Advantageously, to this end, the first region of the bulkhead mounted housing is separated from the second region of the bulkhead mounted housing in a non-destructive manner, as soon as the magnitude of the predefined tensile force is exceeded.

A particular advantage of the invention is provided, in that a separation of the two regions occurs in a reversible manner. Accordingly, there is no mechanical destruction whatsoever. After such separation, the bulkhead mounted housing can immediately be manually re-assembled in situ and re-used, such the rectangle plug connection, after a successful emergency separation, can be re-established with the minimum complexity, i.e. restored to its original state. This is of particular importance in the context of the use of industrial installations and production lines, in order to permit the most rapid possible resumption of operation, where applicable.

A rectangle plug connection of this type can comprise a bulkhead mounted housing of rectangular cross-section, having a first insulator and a mating plug with a mating plug housing of rectangular cross-section, and a second insulator. The first region of the bulkhead mounted housing can incorporate a first fixing section and, specifically at said first fixing section, can be affixed to a surface, e.g. to a wall, specifically to the wall of the switch cabinet, e.g. by screw fixing thereto. Alternatively, the bulkhead mounted housing, at its first region, specifically at its first fixing section, can be affixed to a surface mounted housing, e.g. by screw fixing thereto. To this end, the surface mounted housing can incorporate an extension opening, to which the bulkhead mounted housing is fitted, specifically by screw fixing. The surface mounted housing, in turn, for example by means of an associated screw-in flange, can be screw-fixed onto a surface, e.g. a wall. The surface mounted housing can further incorporate, for example, a lateral cable inlet such that, in its function, it is not bound to a cable bushing through the surface, for example through a wall bushing.

The first insulator can thus, for example, be cabled on the switch cabinet side or on the surface mounted housing side, and can preferably be fitted, or is at least fittable to a first region of the bulkhead mounted housing, specifically at an associated first fixing section. The first insulator can thus be fitted or is fittable to the first fixing section, whether directly or indirectly, e.g. via fixing means such as e.g. threaded bolts.

Preferably, the first region incorporates a plurality of threaded bolts for the attachment of the first insulator. To this end, the first fixing section can incorporate a plurality of screw openings or through openings, advantageously with associated nuts or bolts, for the attachment of threaded bolts on the first fixing section. To this end, for example, the threaded bolts, at their first end, can be screwed to the through openings of the first fixing section. The first insulator can then, for example by means of a flange which is associated with the insulator, be affixed to the respective opposing second end of the respective threaded bolt, specifically by screwing. The first insulator can comprise a plug side and a cable connection side arranged in opposition thereto. The flange of the insulator can be arranged, for example, on the cable connection side, or between the cable connection side and the plug side of the insulator.

The first fixing section can incorporate a window, on which the first insulator is arranged at its cable connection side, or through which it projects.

In one possible configuration, the first insulator which is thus fitted to the first fixing section can be preferably located, in part, in the bulkhead mounted housing and/or in part, specifically at its cable connection side, on the opposing side of the first fixing section, and thus e.g. on the switch cabinet side. Conversely, if the bulkhead mounted housing is fitted to a surface mounted housing, the first insulator can then optionally be located, at least partially, in the bulkhead mounted housing and/or at least in part, specifically at its cable connection side, in the surface mounted housing. To this end, the first insulator can project through the first window.

In a preferred configuration, the first insulator, at its cable connection side which is arranged in opposition to the plug-in direction, is arranged for cabling on the first window and, at its plug side, projects from the second region of the bulkhead mounted housing for connection to a second insulator which is arranged in a mating plug housing, in the plug-in direction. The insulator, at its cable connection side, can thus be located in the bulkhead mounted housing but, advantageously, is arranged sufficiently close to the first window, such that cabling can be completed in a problem-free manner, without the removal of the insulator.

The first fixing section can further comprise a plurality of first feedthrough openings. By means of these first feedthrough openings, for example, the screw threads of corresponding fixing means can be accommodated, which are employed for the screw-fixing of the first region onto a surface, specifically the switch cabinet wall, or to the surface mounted housing. The attachment of the first insulator to the first region is fundamentally advantageous, since the first insulator, by way of its cable connection side cabling, thus remains on the extension side in the event of emergency separation.

A further advantage of the invention is provided, in that existing and previously cabled power distribution systems, with only limited complexity, can be retrofitted with a solution according to the invention, for example in order to permit the adaptation thereof to corresponding safety standards. The mating plug, with its mating plug housing and its cabled second insulator located therein, can thus remain completely unchanged. The first insulator and its cabling can likewise, in general, be left as they stand. As a result, in comparison with a completely new installation, substantial savings in time and money are achieved. For the retrofitting of the rectangle plug connection, it is simply necessary for a conventional bulkhead mounted housing of a previously installed plug connection to be replaced with a bulkhead mounted housing according to the invention. This provides an advantage, in that retrofitting is associated with very low complexity.

In an advantageous configuration, upon retrofitting, the optionally present surface mounted housing can also be replaced with an advantageously modified surface mounted housing. Although this is not absolutely necessary for the separating function according to the invention, it can be advantageous with respect to structural details such as e.g. the sealing of the housing.

Optionally, a combination of a surface mounted housing and a bulkhead mounted housing, in the assembled state, can be replaced by way of a retrofit system. This optionally provides the advantage of a corresponding time saving during retrofitting.

For the fitting of the bulkhead mounted housing, existing fixing elements can be provided in the surface mounted housing and, in a preferred configuration, can be offset vis-à-vis the extension opening, such that an offset exists between the fixing elements and the extension opening. The fixing elements can, for example, be webs, which extend outwardly from the extension opening into the surface mounted housing and are integrally molded in the latter, and incorporate a threaded bore in their longitudinal direction.

In an advantageous further development, the first region of the bulkhead mounted housing incorporates the above-mentioned first fixing section.

This can specifically be configured to a planar, and preferably one-piece design, and can be comprised, for example, of a metallic material, e.g. sheet steel or aluminum. The first fixing section can specifically assume a thickness which optionally corresponds to the above-mentioned offset of the screw elements in the surface mounted housing. The first fixing section, for the consolidation of an improved housing seal, is preferably insertable into the surface mounted housing in a form-fitted arrangement and, particularly advantageously, terminates flush to the extension opening thereof. The first fixing section can incorporate the above-mentioned first window which, specifically, is centrally arranged in the first fixing section. In the assembled state, the first insulator can project through this window. Preferably, the first window can assume an essentially rectangular shape, in order to enclose the first insulator, which preferably assumes an essentially rectangular cross-section, in a particularly space-saving manner.

According to a first aspect, the function of the first fixing section is the attachment of the first region, e.g. to a surface, for example a wall, specifically the wall of the switch cabinet. The first fixing section can advantageously be configured such that it additionally provides the option for attachment to the surface mounted housing. This attachment can be executed in each case by means of screw connection. To this end, the first fixing section can incorporate a series, specifically of four first through openings, by means of which it can be attached to the above-mentioned surface, e.g. the switch cabinet wall, but also to the surface mounted housing, specifically by screw fixing.

Secondly, the first fixing section can be employed for the attachment of the insulator. To this end, it can further incorporate a series of screw openings, which are characterized by an internal thread, or two through openings, e.g. each having an associated nut or bolt, for the screwing in or screw-fixing of the threaded bolts. Accordingly, the threaded bolts, at their first end, can be attached to the first fixing section. At an opposite second end of the threaded bolts, the first insulator, e.g. at its plug region, can be retained, and can simultaneously, at its cable connection side, project through the first window of the first fixing section and thus, in the assembled state, e.g. into the switch cabinet or the surface mounted housing, and can be thus partially arranged therein.

In a preferred further development, the first region incorporates at least one first latching element and the second region incorporates at least one second latching element, wherein the first and the second latching element can be latched together and, by the action of a defined separating force, are reversibly separable from one another.

In an advantageous configuration, the first region incorporates a series of first latching elements, which are specifically configured as a constituent element of guide pins. Each of these guide pins, at a first end, incorporates a threaded region, specifically a cylindrical threaded section having a screw thread and, at an opposing second end, the above-mentioned first latching element, which can be configured, for example, in the form of a latch stud. The guide pins can thus assume a dual function, namely, on the one hand, the attachment of the first region of the bulkhead mounted housing to the surface or the surface mounted housing, specifically by screwing and, on the other hand, reversible latching with the second region, specifically with the second latching elements which are associated with the second region. For example, to this end, each second latching element can incorporate an appropriate, specifically an essentially cylindrical latching recess, each of which is appropriate for latching with the respective latch stud of the guide pin and, by the action of a defined so separating force, for the further unlatching therefrom. For example, the second latching element can assume an overall cylindrical shape, and is able to be screw-fixed to the second region, specifically to a second fixing section of the second region.

The magnitude of the predefined tensile force which results in the separation of the two regions of the bulkhead mounted housing can be determined from the sum of the separating forces of the individual latching element pairs. If the bulkhead mounted housing comprises, for example, four identical first latching elements and four identical second latching elements, the predefined tensile force can constitute four times the separating force of an individual latching element pair, comprised of a first and a second latching element.

From the sum of the individual separating forces, the overall tensile force is thus derived which is required to act on the rectangle plug connection, in order to trigger protective separation.

Naturally, in an alternative configuration, the latching recesses can also be arranged on the first latching elements of the first region, and the latch studs can be arranged on the second latching elements of the second region.

The second region can comprise a preferably rectangular frame. This frame is appropriate for interlocking with first locking means on the mating plug and, to this end, comprises second locking means.

In an advantageous configuration, the first locking means of the mating plug can comprise a locking bracket and the second locking means of the second region can comprise locking studs. Accordingly, the requisite high retaining force can be achieved, even with a comparatively low actuation force.

In a preferred configuration, however, the locking arrangement can be configured as a screw connection, such that the first locking means is constituted e.g. by one or more housing projections, each having a screw passage and a corresponding locking screw, and the second locking means are constituted by a screw opening, e.g. a screw opening having an appropriate internal thread. Specifically, to this end, the frame can incorporate one or more projections. In these projections, the screw openings can then be arranged for screw connection with the locking screws of the mating plug.

On its inner side, the frame can incorporate means for the attachment of the second latching elements. These means are advantageously appropriate for the maintenance of the second latching elements in an exceptionally stable manner, specifically during the unlatching process. These means can comprise, for example, the above-mentioned second fixing section. This can be arranged in the planar direction of the frame, i.e. perpendicularly to the plug-in direction, preferably on a side of the second region, specifically of the frame, which faces the first region. For example, the second fixing section can be configured in the form of a interior flange on the frame edge. In other words, the second fixing section is configured in a flat-surface arrangement, and advantageously comprises a preferably essentially rectangular second window, which is centrally arranged in said surface. This second window, specifically in the longitudinal direction, can be larger than the first window such that, upon the assembly of the two regions, the threaded bolts of the first fixing section, with the first insulator which is secured thereto, can project through the second window. Accordingly, the first insulator, at its plug side, can project through the window in the second region, specifically in the frame of the second region, either into or entirely through the second region, specifically the frame of the second region such that, e.g. in the plugged-in state, it projects into the mating plug.

The second fixing section can further comprise second feedthrough openings for the insertion of the first latching elements, specifically the guide pins. On the second feedthrough openings, the second latching elements can be arranged, specifically by screw fixing. Specifically, the second latching elements can be located on the side of the frame, i.e. essentially within the frame, such that the first latching elements, specifically the guide pins, by way of their latch studs, can be fed through the second feedthrough openings of the second fixing section, and can thus be latched to the second latching elements. This provides an advantage, in that the second latching elements, upon the unlatching process, are retained on the second region in a particularly stable manner, specifically on the grounds of the engagement of the second fixing section to the rear thereof.

The bulkhead mounted housing advantageously assumes an essentially rectangular shape, specifically at its outer edge. For example, the frame of the second region can comprise two mutually parallel long sides and two mutually parallel short sides arranged at right-angles thereto. The corners of the frame can, for example, be rounded. Accordingly, the first and the second fixing section can assume an essentially rectangular shape, with rounded corners. The first and the second windows can assume an essentially rectangular shape. At two diagonally opposing corners, for example, the frame can incorporate the projections with the screw openings for interlocking with the mating plug, wherein its essentially rectangular basic shape is retained, as it can cooperate with the further rectangle plug connector system in a custom-fit manner. For example, the essentially rectangular shape of the bulkhead mounted housing thus constituted is naturally particularly advantageous for employment as a protective separator for a rectangle plug connection.

BRIEF DESCRIPTION OF THE DRAWINGS

An exemplary embodiment of the invention is represented in the drawings, and is described in greater detail hereinafter. In the drawings.

The figures include partially simplified schematic representations. In part, identical reference symbols are applied to equivalent, but optionally not identical elements. Different views of the same elements could be scaled in different ways.

DETAILED DESCRIPTION OF THE INVENTION

Figure 1A:
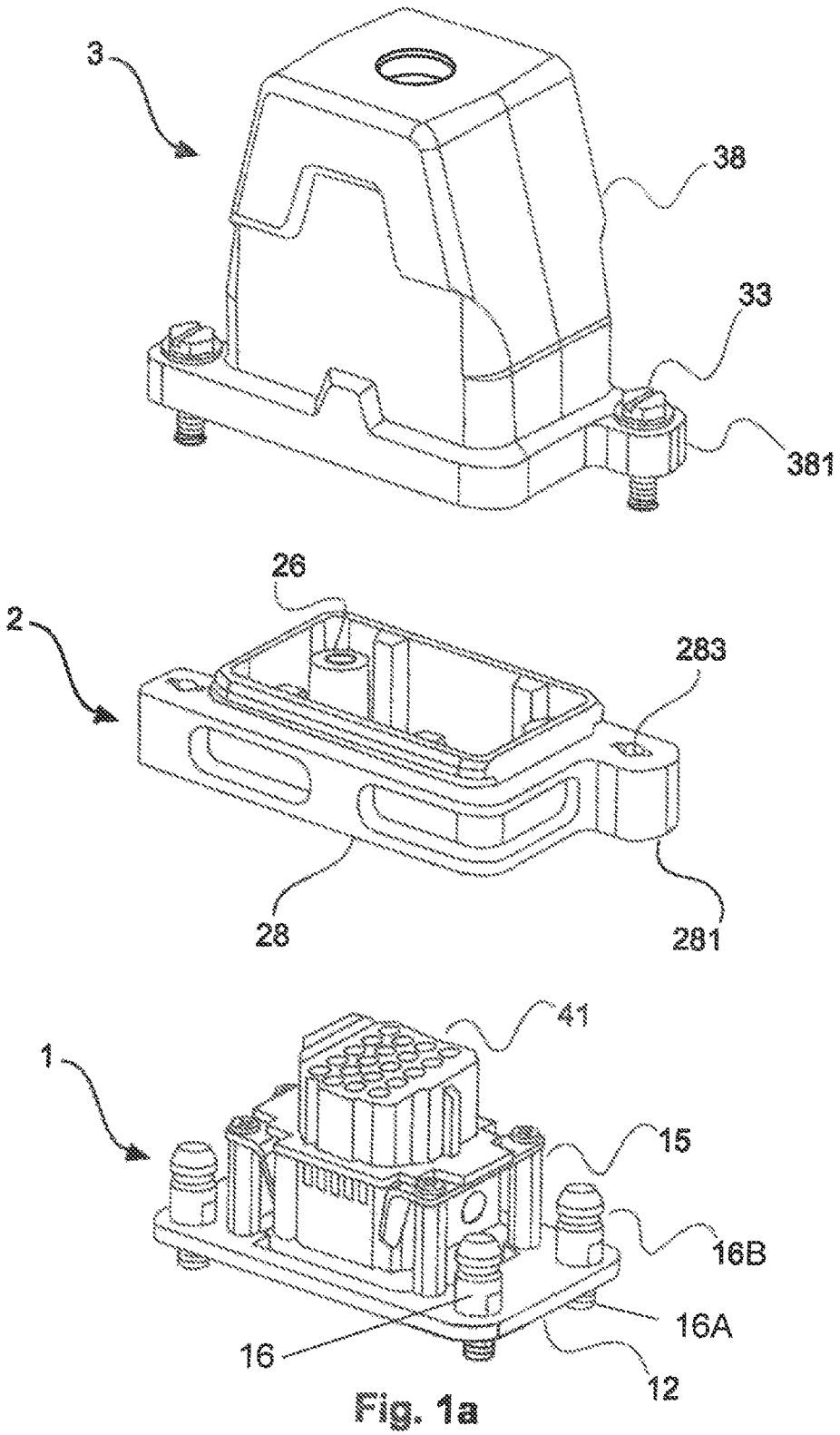
FIGS. 1*a, b* show a plug connection with a mating plug housing, together with a first and second region of a bulkhead mounted housing.
Figure 1B:
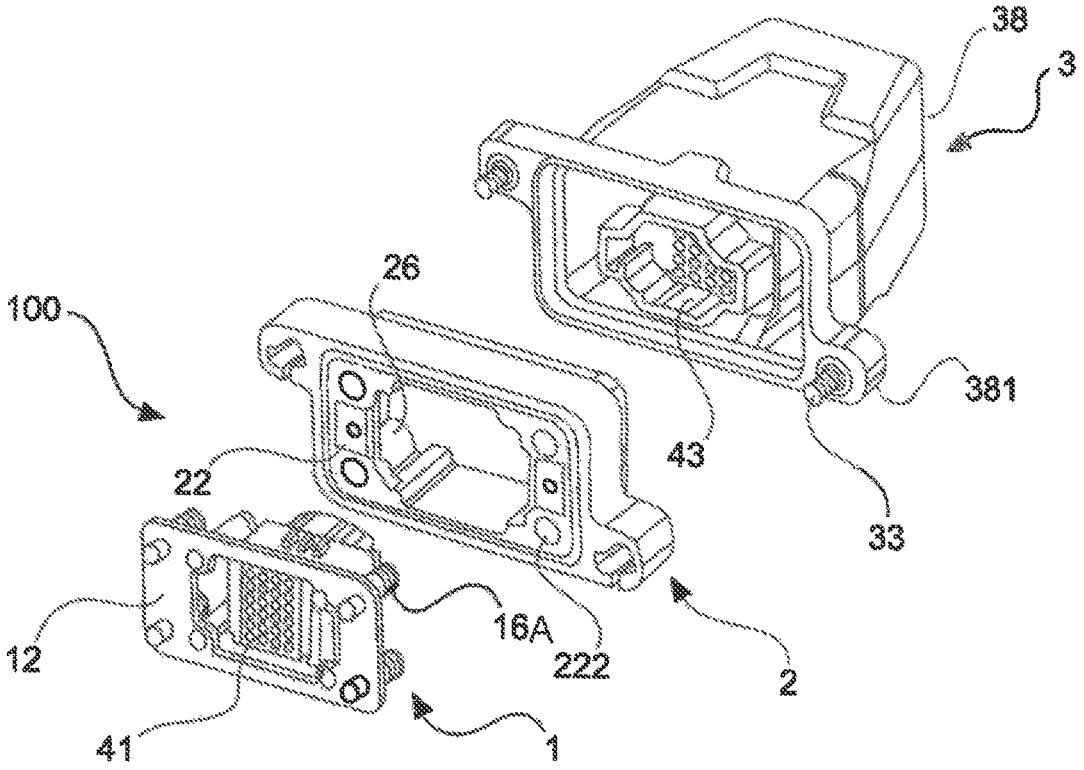
FIG. 1*c* shows the assembled bulkhead mounted housing.
Figure 1C:
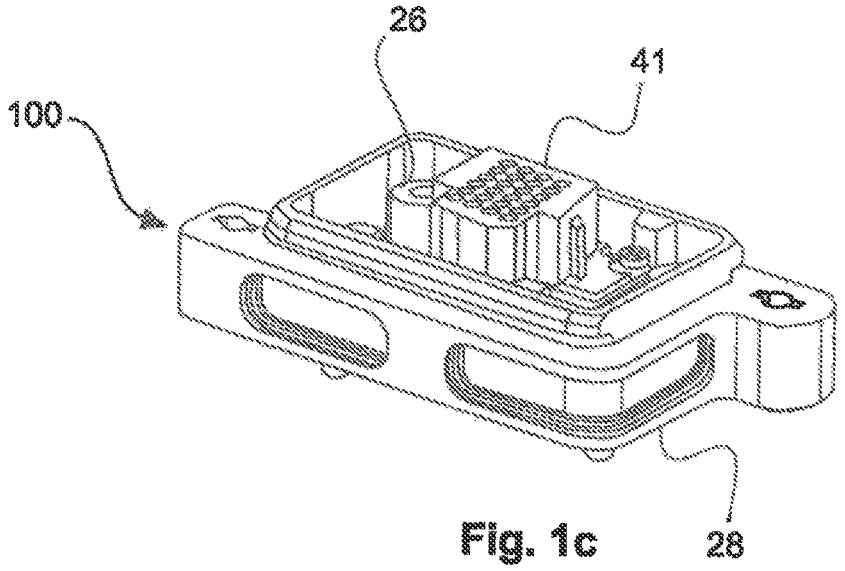

FIGS. 1*a* and 1*b* show a rectangle plug connection with a mating plug housing 3, together with a first region 1 and a second region 2 of a bulkhead mounted housing 100, from two different perspectives. FIG. 1*c* shows the bulkhead mounted housing 100 assembled from the first region 1 and the second region 2.

FIG. 1*a*, in an oblique overhead view, shows a particularly clear representation of the attachment of a first insulator 41 to the first region 1 of the bulkhead mounted housing. To this end, the first region 1 incorporates a first fixing section 12, to which four threaded bolts 15 are screw-fixed at their first end. In this representation, however, only three threaded bolts 15 are visible, as the fourth is concealed by the insulator 41. At the second end of these threaded bolts 15, the first insulator 41 is secured to the threaded bolts 15 at its flange, which is not represented in greater detail. This representation shows a view of the plug side of the insulator 41. The first region further incorporates four guide pins 16 of which, in this representation, only three guide pins 16 are visible, as the fourth is concealed by the insulator 41. These guide pins 16 incorporate, at their first end, a threaded region, namely, a cylindrical section having a screw thread 16A, by means of which the guide pins 16 are inserted through feedthrough openings 122 in the first fixing section 12, in opposition to the plug-in direction. The first region 1 of the bulkhead mounted housing 100 can thus be secured to a surface or to a surface mounted housing 5, which is explicitly represented in FIGS. 3*a* and 3*b*. At their second end, the guide pins 16 incorporate first latching elements in the form of latch studs 16B for latching with second latching elements 26 of the second region 2 of the bulkhead mounted housing 100.

This second region 2 comprises a frame 28, which is configured to an essentially rectangular design. It comprises a rectangular inner edge, the corners of which are slightly rounded. It further comprises a rectangular outer edge, which is likewise rounded at two diagonally opposing corners. At the other two diagonally opposing corners, projections 281 are provided, having screw openings 283 for interlocking with the mating plug 3.

The mating plug 3 has a mating plug housing 38 with threaded projections 381, each having a screw passage in which one locking screw 33 respectively is arranged.

FIG. 1*b* shows the rectangle plug connection from an opposing perspective in which, inter alia, the cable connection side of the first insulator 41, which is arranged on a first window 124 of the first fixing section 12, can be seen through said first window 124, not shown here in the interests of clarity. In the interests of clearer understanding, the first region 1, with its first window 124, is particularly clearly represented in FIGS. 4*a* and 4*b*, and is explicitly identified. The first insulator 41, as per the description of the preceding representation, is secured to the first region 1 by means of threaded bolts 15. The mating plug 3 incorporates a second insulator 43, the plug side of which can be dearly seen in this representation. This is intermateable with the plug side of the first insulator 41.

Both the first region 1 and the second region 2 form part of the bulkhead mounted housing 100. In this representation, however, they are still separated from each other, i.e. they are not yet latched together by means of their latching elements 16, 26.

Conversely, FIG. 1*c* shows the assembled bulkhead mounted housing 100. The first region 1, with the insulator 41 attached thereto, is thus inserted into the second region 2 and is latched thereto. To this end, the guide pins 16 thereof project through a second fixing section 22 of the second region 2, through the second feedthrough openings 222 thereof, into the latching recesses 261 of the second latching elements 26 of the second region 2. The latch studs of the guide pins 16 then latch into the latching recesses 261 of the second latching elements 26. In the interests of dearer understanding, the second region 2, with the second feedthrough openings 222 thereof, and with the second latching elements 26, with the latching recesses 261 thereof is represented in a particularly clear manner and explicitly identified in FIGS. 6*a* and 6*b*.

Figure 2C:
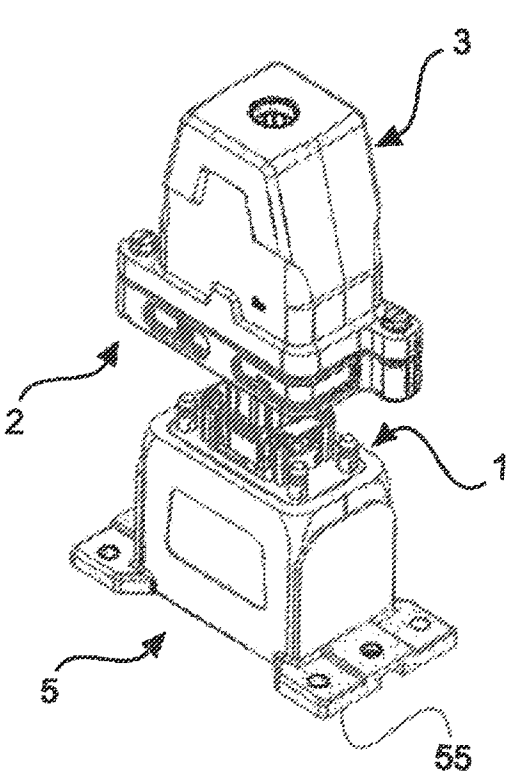
FIGS. 2*a, b, c* show a procedure for the plug-in and the emergency release of the rectangle plug connection, in three phases.
Figure 2B:
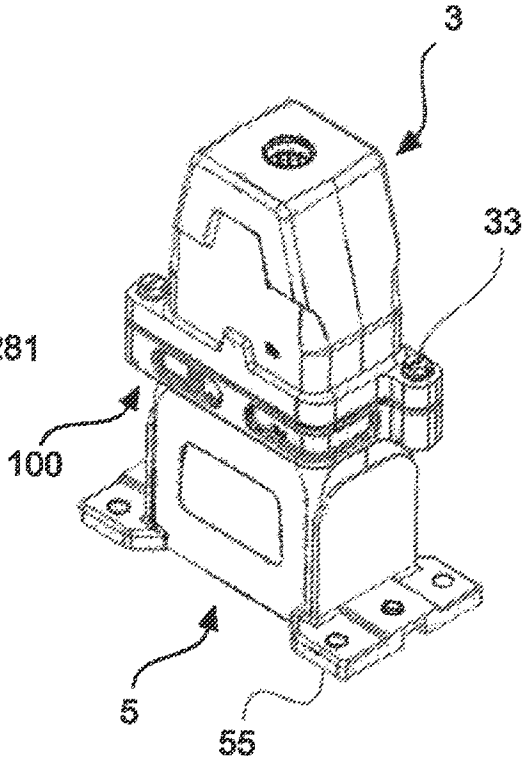
Figure 2A:
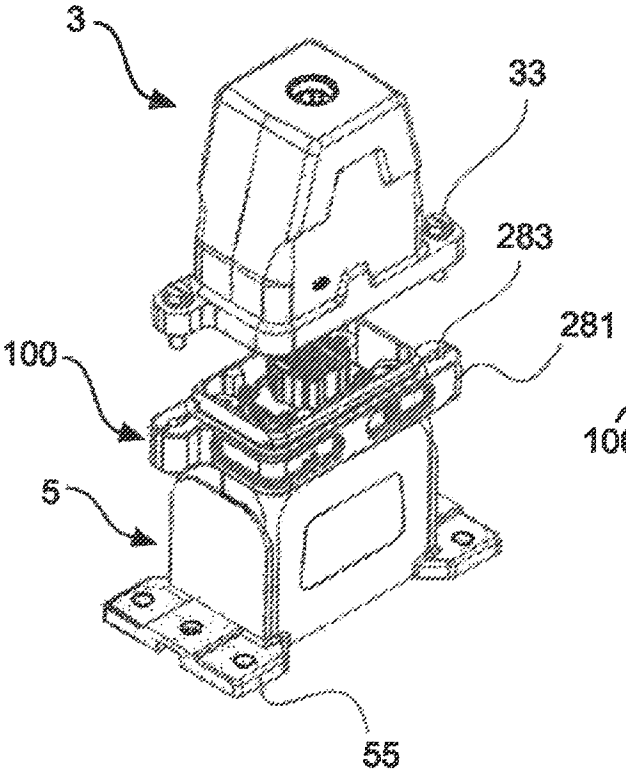

FIGS. 2*a*, 2*b* and 2*c* represent the functionality of the protective separator in three different snapshots. The rectangle plug connection comprises the above-mentioned surface mounted housing 5, the bulkhead mounted housing 100 and the mating plug 3. In this case, the first region 1 of the bulkhead mounted housing 100 is secured to the surface mounted housing 5 by a screw connection, by means of the screw thread on its guide pins 16. The surface mounted housing 5 further incorporates a screw-in flange 55 by means of which, in turn, it can be attached to a surface.

In FIG. 2*a*, the second region 2 is latched into the first region 1 and, in combination with the latter, constitutes the bulkhead mounted housing 100. This bulkhead mounted housing 100 is fitted to an extension opening 51 of the surface mounted housing 5, which is also particularly clearly visible in FIG. 3*a*. The mating plug 3, shortly beforehand, is intermated with the bulkhead mounted housing 100 and, by means of its locking screws 33, is interlocked by screwing into the screw openings 283 of the bulkhead mounted housing 100, as represented hereinafter in FIG. 2*b*. Here, the mating plug 3 is securely locked to the second region 2 of the bulkhead mounted housing 100 by the above-mentioned screw fixing.

Emergency separation is represented in FIG. 2*c*. To this end, the mating plug housing 3 is removed from the surface mounted housing 5 with a predefined tensile force. As a result, the two regions 1, 2 of the bulkhead mounted housing 100 are separated from each other. The first region 1, together with the first insulator 41, remains on the surface mounted housing 5 by its screw connection to the threaded bolts 15. The second region 2 remains on the mating plug 3 by the locking thereof, in this case by means of the above-mentioned screw connection.

In this emergency separation, the individual latching elements 168, 26 are separated from one another. This is executed in each case by means of a defined separating force. As four similar pairs of latching elements 16B, 26 are involved, the predefined tensile force is equal to four times the defined separating force for the individual latching element pairs 168, 26. The plug connection can thus be separated in a non-destructive and reversible manner, by the application of a predefined tensile force.

Figure 3A:
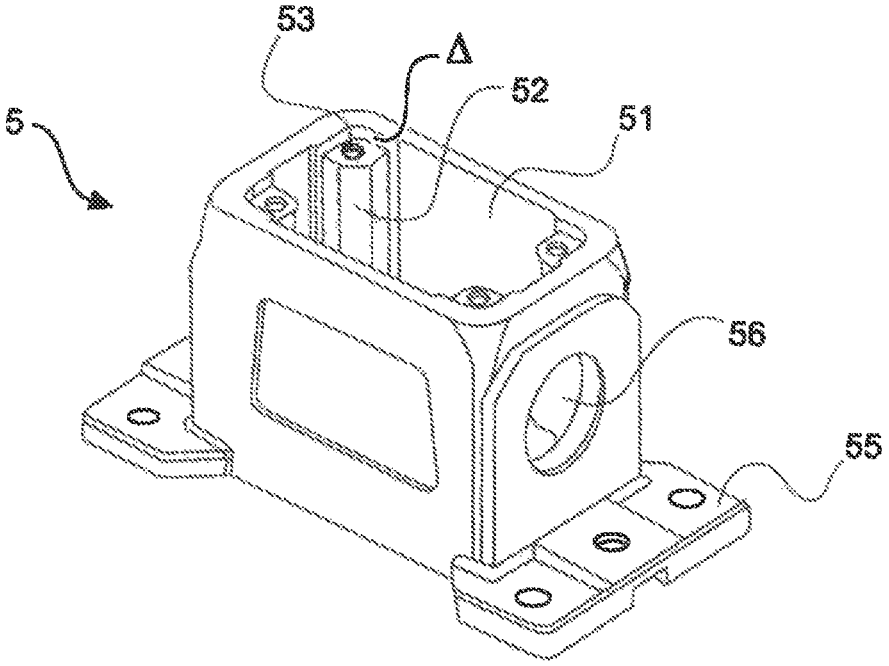
FIGS. 3*a, b* show a surface mounted housing in various views and configurations.

FIG. 3*a* shows a separate representation of the surface mounted housing 5, in an oblique overhead view. In addition to its screw-in flange 55, the surface mounted housing 5 incorporates a lateral cable inlet 56. The plug connection can thus be operated independently of a wall bushing. The surface mounted housing further incorporates fixing elements for the fixing of the first region 1 of the bulkhead mounted housing 100. The fixing elements comprise webs 52, which extend outwardly from the extension opening 51 into the surface mounted housing 5 and are integrally molded in the latter, and incorporate a threaded bore 53 in their longitudinal direction. These webs 52 are arranged with an offset vis-à-vis the extension opening, such that an offset Δ exists between the webs 52 and the extension opening 51. The surface mounted housing 5 is thus advantageously modified such that, by means of this offset Δ, the first fixing section 12 is accommodated in a form-fitted arrangement. This contributes, for example, to the particularly effective sealing of the surface mounted housing 5.

Figure 3B:
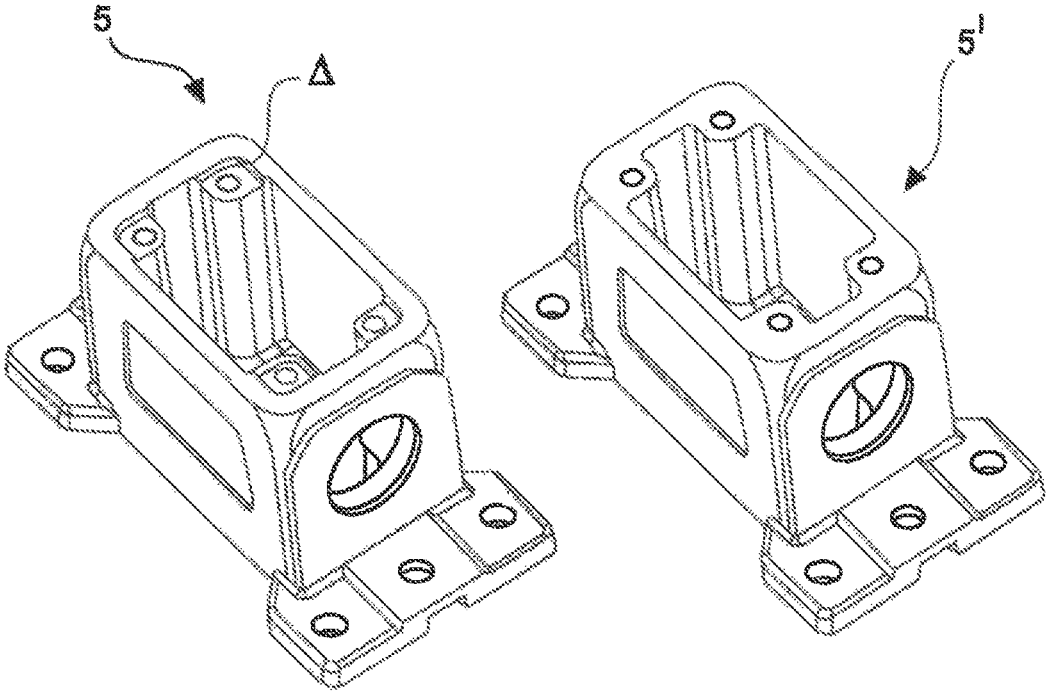

FIG. 3*b* shows the advantageously modified surface mounted housing 5, in comparison with a surface mounted housing 5' in which no offset Δ is provided. A bulkhead mounted housing 100 can also be screwed onto this surface mounted housing 5' at the first fixing section 12 of its first region 1. In this case, however, this first fixing section 12 cannot be accommodated in a form-fitted arrangement, and the surface mounted housing 5' is thus less effectively sealed as a result. In conjunction with the retrofitting of an existing rectangle plug connection, a surface mounted housing 5' of this type can be replaced with an advantageously modified surface mounted housing 5. The bulkhead mounted housing 100 can thus be screwed directly onto the advantageously modified surface mounted housing 5, such that the replacement operation is as ergonomic as possible for the user.

Figure 4A:
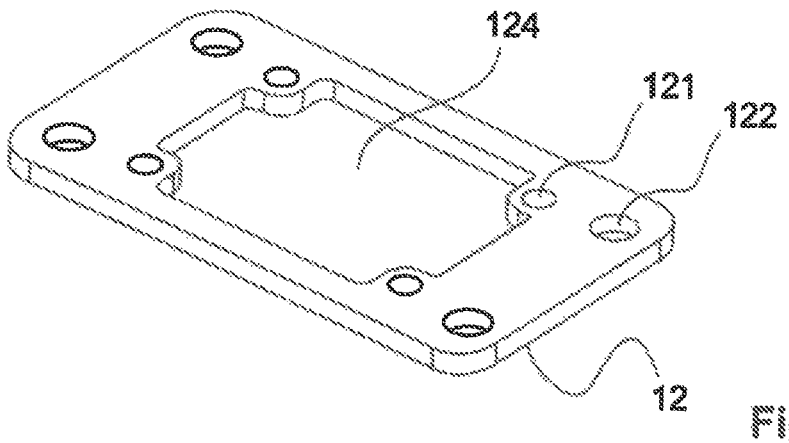
FIGS. 4*a, b, c* show a first fixing section, with nuts and threaded bolts.
Figure 4B:
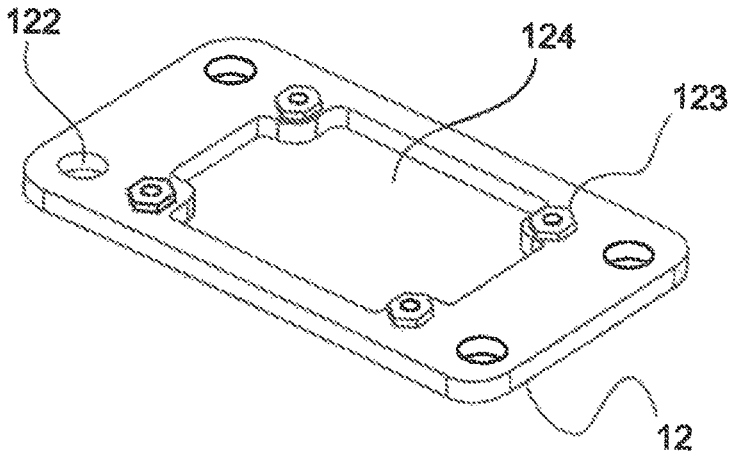
Figure 4C:
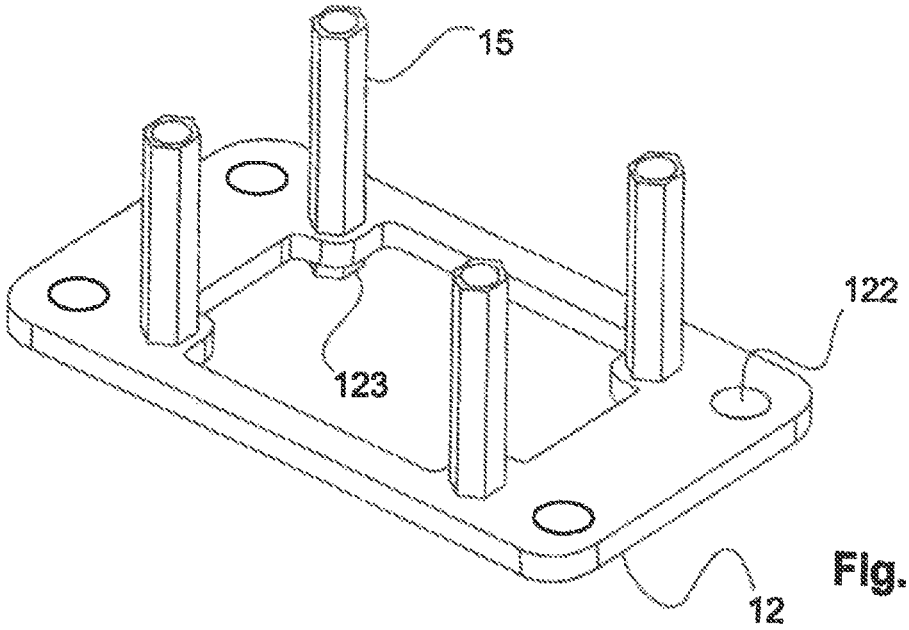

FIGS. 4*a*, 4*b* and 4*c* show the first fixing section 12, both with and without the four threaded bolts 15, which are screwed by means of nuts 123 onto the first through openings 121. The first fixing section 12 further incorporates four first feedthrough openings 122 for screwing to a surface or to the surface mounted housing 5 by means of the guide pins 16. In the first fixing section 12, a first window 124 is centrally arranged for the cabling of the first insulator 41, which is to be secured to the threaded bolts 15.

Figure 5A:
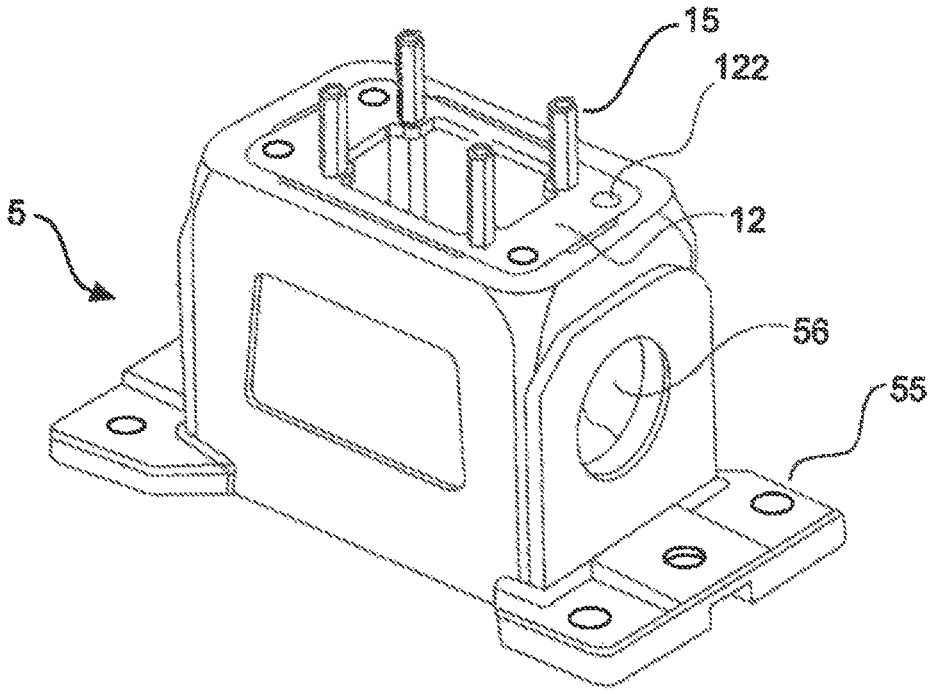
FIGS. 5*a, b* show a surface mounted housing, with the first region of the bulkhead mounted housing.
Figure 5B:
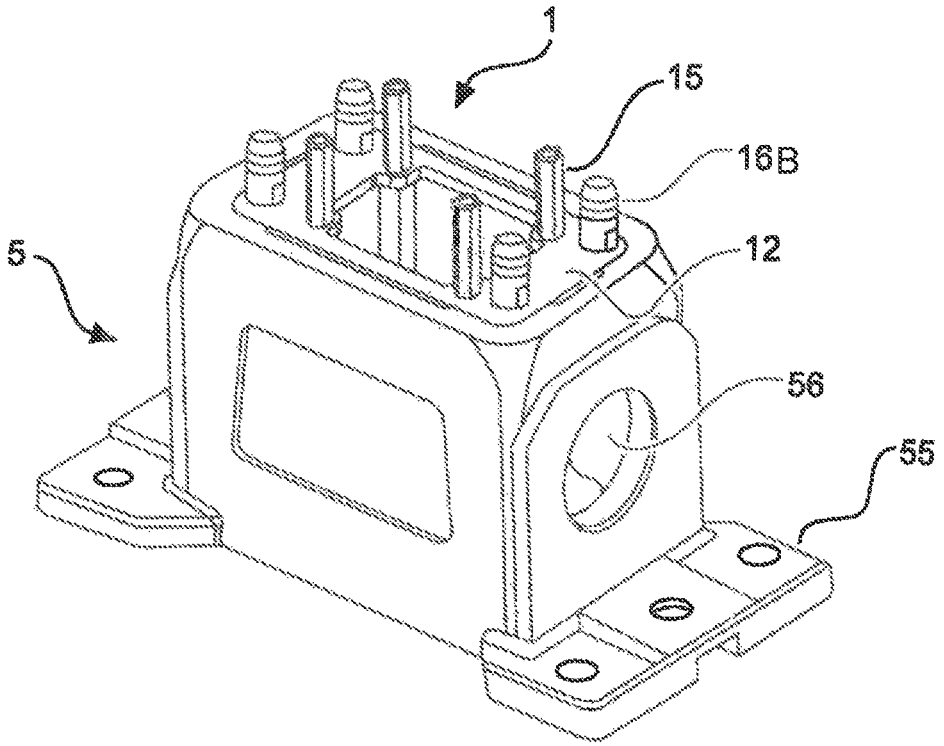

FIGS. 5*a* and 5*b* show the surface mounted housing 5, in which the first region 1 of the bulkhead mounted housing 100 is inserted in a form-fitted manner. The first region 1 comprises the first fixing section 12 with the threaded bolts 15. In FIG. 5*b*, it is further screwed by means of the screw threads of its guide pins 16 on the threaded bores 53 of the webs 52 of the surface mounted housing 5. The first region 1 of the bulkhead mounted housing 100 is thus attached to the surface mounted housing 5.

Figure 6A:
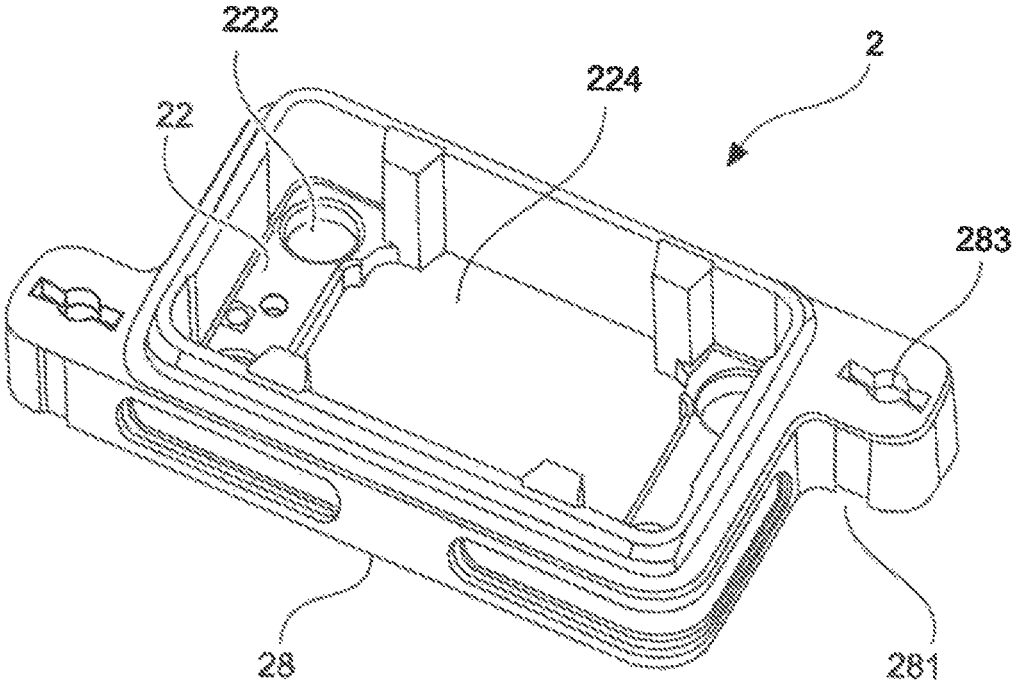
FIGS. 6*a, b* show the second region of the bulkhead mounted housing.
Figure 6B:
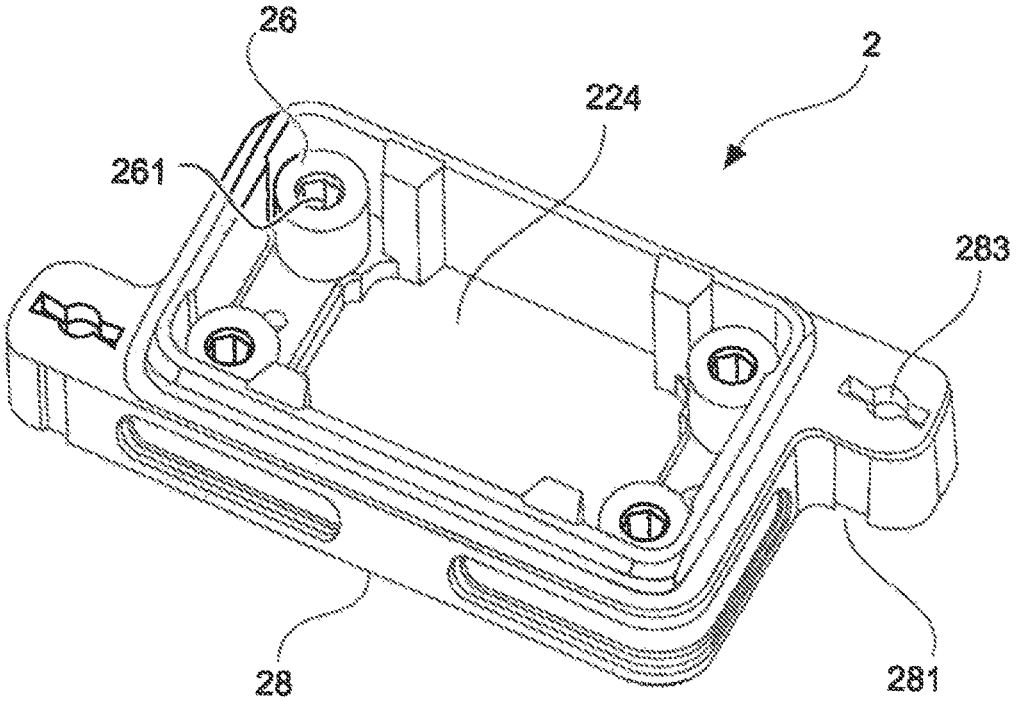

In FIGS. 6*a* and 6*b*, the second region 2 of the bulkhead mounted housing 100 is represented. This incorporates a frame 28 and a planar second a fixing section 22 arranged therein, with a second window 224 and four second feedthrough openings 222. By means of the second window 224, the second fixing section 22 assumes the form of an internal flange.

As represented in FIG. 6*b*, the second latching elements 26 are arranged on the second feedthrough openings 222. For the attachment thereof to the second fixing section 22, the second latching elements 26 are thus screwed into the second feedthrough openings 222. To this end, each of the second feedthrough openings 222 is provided with an internal thread, and the second latching elements 26 incorporate a matching external thread.

Figure 7A:
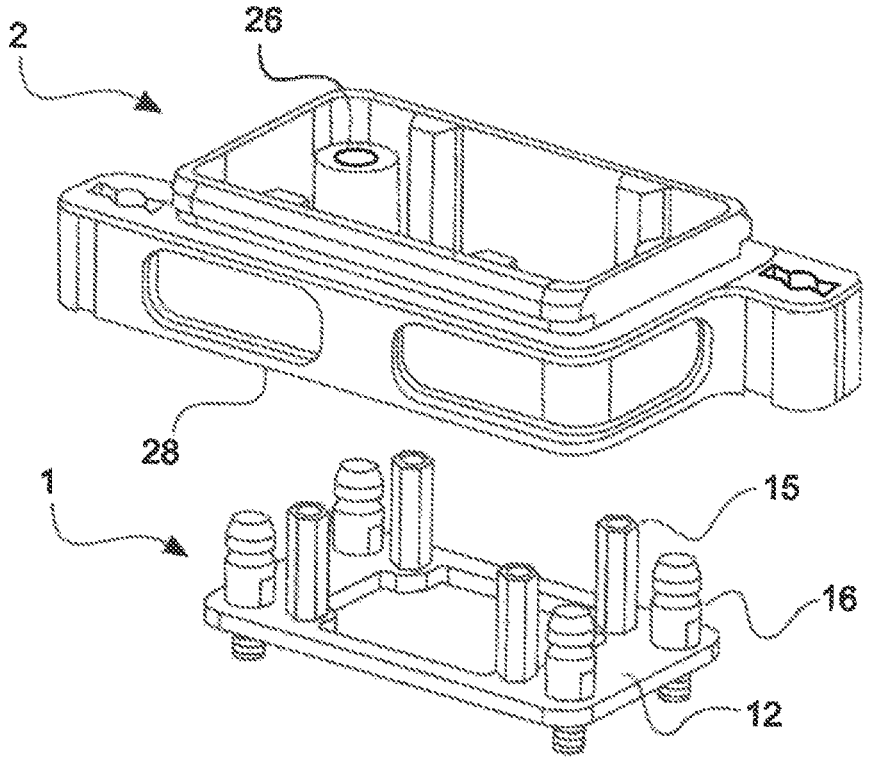
FIGS. 7*a, b* show the first and second region of the bulkhead mounted housing, prior to the mutual latching together thereof.
Figure 7B:
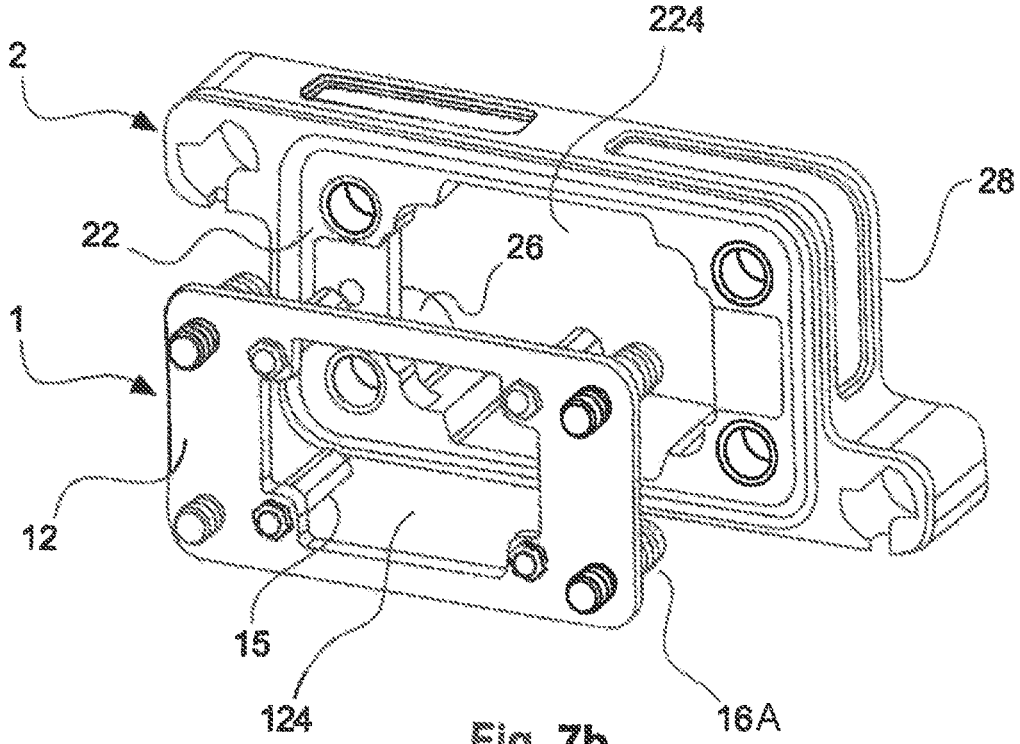

FIGS. 7*a* and 7*b* show the first 1 and the second region 2 of the bulkhead mounted housing 100, prior to the mutual latching thereof. In FIG. 7*b*, it can dearly be seen that the guide pins 16, originating from the direction of the second fixing section 22 and penetrating the second feedthrough openings 222, can appropriately be inserted in the latching recesses 261 of the second latching elements 26, and are latched therein by means of their latch studs. Conversely, the second latching elements 26, upon unlatching from the second fixing section 22, are retained in a particularly stable manner, as they are arranged on the side of the planar second fixing section 22 which is averted from the first region 1, and are thus secured by the latter 22 to the rear during the unlatching process.

Moreover, it can dearly be seen that the second window 224, at least in so the longitudinal direction, is larger than the first window 124 such that, upon the assembly of the two regions 1, 2, the threaded bolts 15 of the first fixing section 1 can project through the second window 224.

Figure 8A:
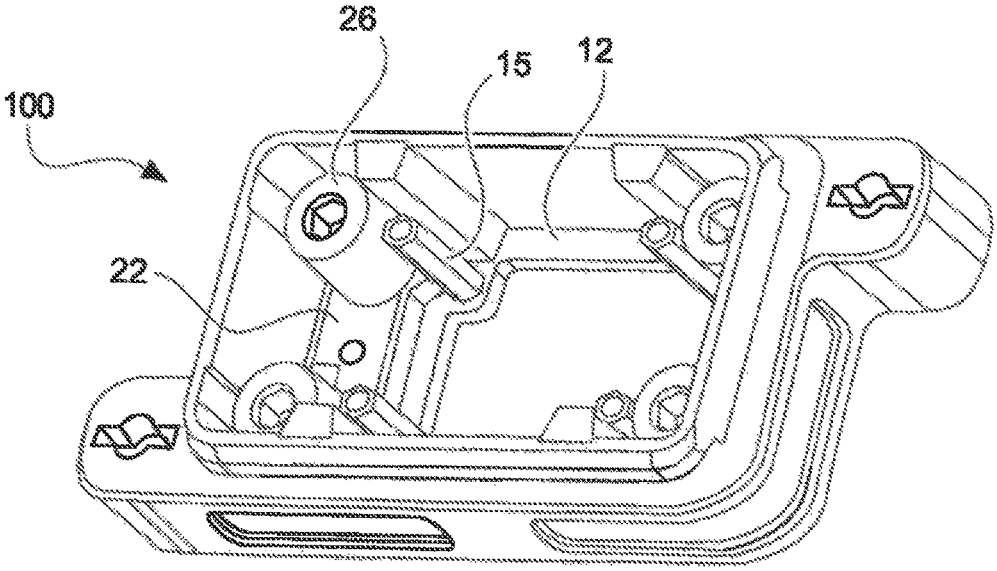
FIGS. 8*a, b* show the assembled bulkhead mounted housing, with and without a first insulator.
Figure 8B:
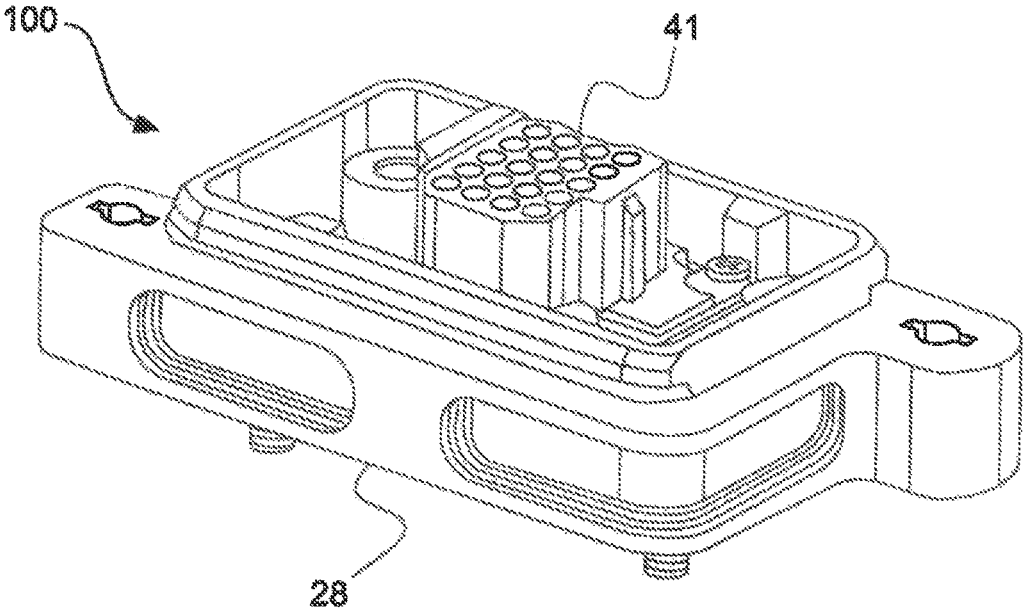

FIGS. 8*a* and 8*b* show the assembled bulkhead mounted housing 100, both a with and without the insulator 41 attached thereto.

In FIG. 8*a*, it can dearly be seen how the threaded bolts 15 project through the first window 124 into the second region 2 of the bulkhead mounted housing 100.

FIG. 8*b* shows how the insulator 41 which is attached thereto projects through the second region 2 such that, in the plugged-in state, it extends into the mating plug 3 and plugs into the second insulator 43.

LIST OF REFERENCE SYMBOLS

100 Bulkhead mounted housing
1 First region of the bulkhead mounted housing
12 First fixing section
121 Through openings
122 First feedthrough openings
123 Nuts
124 First window
15 Threaded bolts
16 Guide pins with latch studs
2 Second region of the bulkhead mounted housing
22 Second fixing section
222 Second feedthrough openings
224 Second window
26 Second latching elements
261 Latching recess
28 Frame
281 Projection
283 Screw opening
3 Mating plug
33 Locking screw
34 Second insulator
38 Mating plug housing
381 Housing projection with screw passage
41 First insulator
43 Second insulator
5, 5' Surface mounted housing
51 Extension opening
52 Fixing elements
53 Threaded bore
55 Screw-in flange
56 Lateral cable inlet
Δ Offset

The invention claimed is:

1. A protective separator for a rectangle plug connection, comprising a bulkhead mounted housing having a first region and a second region, wherein the first region is directly attachable to a surface and/or to a surface mounted housing, and wherein the second region is configured to be locked onto a mating plug housing, wherein the first region and the second region can be mutually separated in a reversible manner by the action of a predefined tensile force;

wherein the first region incorporates at least one first latching element and wherein the second region incorporates at least one second latching element, wherein the first latching element and the second latching element are configured to be latched together and, by the action of a defined separating force, are reversibly separable from one another;

wherein the second region incorporates an essentially rectangular frame;

wherein the frame comprises a second locking element configured for interlocking with one or more first locking elements of the mating plug; and wherein the second locking element comprises projections on the frame, wherein the projections incorporate screw openings for screw attachment with locking screws on the mating plug wherein a first insulator is threadably bolted to the first region.

2. The protective separator as claimed in claim 1, wherein the first latching element projects from a first end of a guide pin, and wherein the guide pin, at its opposing second end, incorporates a screw thread configured for the attachment of the first region to the surface and/or to the surface mounted housing.

3. The protective separator as claimed in claim 1, wherein the first latching element comprises a latch stud and the second latching element comprises a latching recess, wherein the latch stud is configured to be latchable into the latching recess, and is separable therefrom by the action of a defined separating force.

4. The protective separator as claimed in claim 1, wherein the second locking elements are locking studs for interlocking with a locking bracket of the mating plug.

5. The protective separator as claimed in claim 1, wherein the second region incorporates a second fixing section for the attachment of the second latching elements.

6. The protective separator as claimed in claim 5, wherein the second fixing section is configured to an essentially flat-surface design, is oriented perpendicularly to the plug-in direction in the mounted state, and is arranged on a side of the second region which faces the first region.

7. The protective separator as claimed in claim 5, wherein the second fixing section comprises second feedthrough openings, on which the second latching elements are arranged, and wherein the second fixing section further comprises a second window.

8. The protective separator as claimed in claim 7, wherein the bulkhead mounted housing includes a first insulator, at its plug side, configured to project through the second window, into or through the second region.

9. The protective separator as claimed in claim 7, wherein the bulkhead mounted housing includes a first insulator, at its cable connection side which is configured to project in opposition to the plug-in direction, and wherein said first insulator is configured for cabling on the first window and, at its plug side, projects from the second region of the bulkhead mounted housing for connection to a second insulator which is arranged in the mating plug housing, in the plug-in direction.

10. The protective separator as claimed in claim 9, wherein the first fixing section is configured to be insertable into the surface mounted housing in a form-fitted manner.

11. The protective separator as claimed in claim 10, wherein the first fixing section, in the inserted state, terminates flush to the extension opening.

12. The protective separator as claimed in claim 1, wherein the bulkhead mounted housing is configured to assume an essentially rectangular shape.

13. The protective separator as claimed in claim 1, wherein the first region comprises a first fixing section which is attachable, firstly to a surface and/or to the surface mounted housing, and to which secondly the first insulator is attached.

14. The protective separator as claimed in claim 13, wherein the first fixing section is configured to a one-piece and essentially planar design, and is oriented perpendicularly to the plug-in direction.

15. The protective separator as claimed in claim 13, wherein the first fixing section comprises a first window and a plurality of first feedthrough openings configured for screw attachment to the above-mentioned surface or to the surface mounted housing.

16. The protective separator as claimed in claim 13, wherein the first region comprises a plurality of threaded bolts for the fitting of the first insulator to the first fixing section, and wherein the first fixing section further comprises a plurality of screw openings or through openings configured for the attachment of the threaded bolts.

17. The protective separator as claimed in claim 13, wherein the protective separator further comprises a surface mounted housing, wherein the surface mounted housing incorporates an extension opening, on which the bulkhead mounted housing is arranged or can be arranged, wherein the surface mounted housing comprises fixing elements for the attachment of the first fixing section of the bulkhead mounted housing, wherein the fixing elements are arranged with an offset vis-à-vis the extension opening, such that an offset exists between the fixing elements and the extension opening.

18. The protective separator as claimed in claim 17, wherein the fixing elements incorporate threaded bores.

* * * * *